US011224296B2

(12) United States Patent
Micklos

(10) Patent No.: US 11,224,296 B2
(45) Date of Patent: Jan. 18, 2022

(54) MULTI-LAYER MATTRESS

(71) Applicant: SINOMAX USA INC., Houston, TX (US)

(72) Inventor: Josh Micklos, Montgomery, TX (US)

(73) Assignee: SINOMAX USA INC., Houston, TX (US)

( * ) Notice: Subject to any disclaimer, the term of this patent is extended or adjusted under 35 U.S.C. 154(b) by 40 days.

(21) Appl. No.: 16/693,091

(22) Filed: Nov. 22, 2019

(65) Prior Publication Data

US 2020/0229611 A1 Jul. 23, 2020

Related U.S. Application Data

(63) Continuation-in-part of application No. 16/255,758, filed on Jan. 23, 2019, now abandoned.

(51) Int. Cl.
*A47C 27/15* (2006.01)
*A47C 27/20* (2006.01)

(52) U.S. Cl.
CPC ..... *A47C 27/15* (2013.01); *A47C 27/20* (2013.01)

(58) Field of Classification Search
CPC ..... A47C 27/15; A47C 27/20; A47C 27/144
See application file for complete search history.

(56) References Cited

U.S. PATENT DOCUMENTS 4,161,045 A * 7/1979 Regan ..... A47C 27/148 5/727
5,474,362 A * 12/1995 Albecker, III ..... A47C 7/46 297/284.4
5,732,427 A * 3/1998 Parnham ..... A47G 9/1081 5/640
6,061,856 A * 5/2000 Hoffmann ..... A47C 27/148 5/706
6,223,371 B1 * 5/2001 Antinori ..... A47C 27/144 5/655.9
6,513,179 B1 * 2/2003 Pan ..... A47G 9/109 5/636
8,918,935 B2 * 12/2014 Gladney ..... A47C 27/148 5/730
9,259,099 B1 * 2/2016 Larsen ..... A47C 21/046
10,010,183 B2 * 7/2018 DeMore ..... A47G 9/109
10,104,983 B1 * 10/2018 Robins ..... A47C 31/105
10,231,554 B2 * 3/2019 Boyd ..... A47C 27/085
2011/0252569 A1 * 10/2011 Rawls-Meehan ..... A47C 27/14 5/693
2014/0033440 A1 * 2/2014 Tyree ..... A47C 27/148 5/706
2015/0015402 A1 * 1/2015 Boyd ..... A47D 1/006 340/626
2015/0305515 A1 * 10/2015 Arendoski ..... A47C 27/20 5/727
2016/0331150 A1 * 11/2016 Limer ..... A47C 27/15
2017/0156507 A1 * 6/2017 Rawls-Meehan ..... A47C 27/15
2020/0237111 A1 * 7/2020 Micklos ..... A47C 27/148

* cited by examiner

*Primary Examiner* — David R Hare
(74) *Attorney, Agent, or Firm* — Williams Morgan, P.C.

(57) ABSTRACT

A mattress comprising a polyurethane layer; at least one intermediate layer comprising at least one channel, at least one support element, or both, wherein a bottom-most intermediate layer is and disposed directly above the polyurethane layer; and a comfort layer disposed directly above an uppermost intermediate layer. A mattress assembly comprising the mattress and a mattress foundation.

14 Claims, 5 Drawing Sheets

MULTI-LAYER MATTRESS

BACKGROUND OF THE INVENTION

Field of the Invention

Generally, the present disclosure relates to bedding, and, more specifically, to a mattress comprising three layers.

Description of the Related Art

Foam mattresses, such as viscoelastic or so-called "memory foam" mattresses, provide desirably high levels of firmness and support for many users. However, mattresses comprising only viscoelastic foam may lack sufficient support for some users. Also, mattresses comprising only viscoelastic foam may lack desired levels of support for certain regions of a user's body.

The present disclosure may address and/or at least reduce one or more of the problems identified above.

SUMMARY OF THE INVENTION

The following presents a simplified summary of the disclosure in order to provide a basic understanding of some aspects of the disclosure. This summary is not an exhaustive overview of the disclosure. It is not intended to identify key or critical elements of the disclosure, or to delineate the scope of the disclosure. Its sole purpose is to present some concepts in a simplified form as a prelude to the more detailed description that is discussed later.

In one embodiment, the present disclosure is directed to a mattress, comprising a polyurethane layer; at least one intermediate layer comprising at least one channel, at least one support element, or both, wherein a bottom-most intermediate layer is and disposed directly above the polyurethane layer; and a comfort layer disposed directly above an uppermost intermediate layer.

In one embodiment, the present disclosure is directed to a mattress assembly, comprising a mattress comprising a polyurethane layer; at least one intermediate layer comprising at least one channel, at least one support element, or both, wherein a bottom-most intermediate layer is and disposed directly above the polyurethane layer; and a comfort layer disposed directly above an uppermost intermediate layer; and a mattress foundation disposed under the mattress.

In one embodiment, the present disclosure is directed to a mattress, comprising a polyurethane layer; at least one intermediate layer comprising at least one channel extending laterally from a first side to an opposite side and a plurality of support elements disposed in the channel; and a viscoelastic foam layer disposed directly above an uppermost intermediate layer.

The present disclosure may provide for mattresses with improved comfort for users reclining thereon.

BRIEF DESCRIPTION OF THE DRAWINGS

The disclosure may be understood by reference to the following description taken in conjunction with the accompanying drawings, in which like reference numerals identify like elements, and in which.

Figure 1:
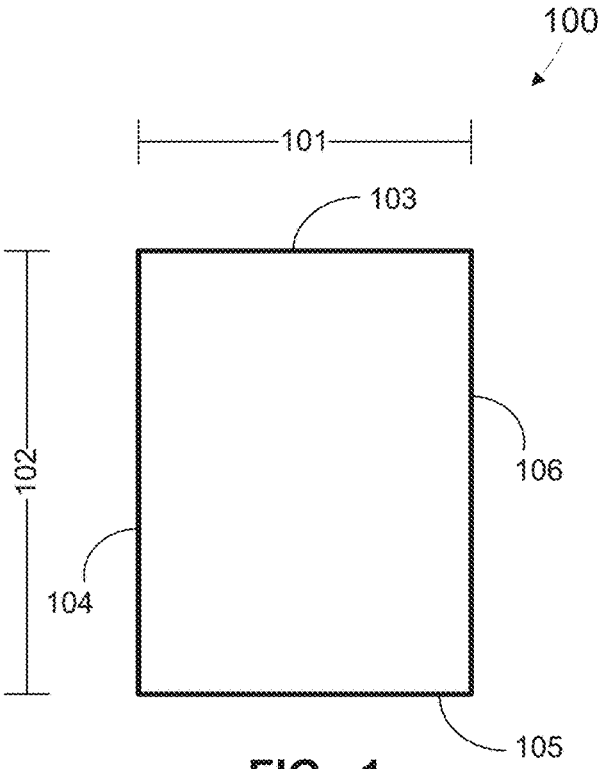
FIG. 1 illustrates a stylized top view of a mattress, in accordance with embodiments herein.

While the subject matter disclosed herein is susceptible to various modifications and alternative forms, specific embodiments thereof have been shown by way of example in the drawings and are herein described in detail. It should be understood; however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

DETAILED DESCRIPTION

Various illustrative embodiments of the disclosure are described below. In the interest of clarity, not all features of an actual implementation are described in this specification. It will, of course, be appreciated that, in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would be a routine undertaking for those of ordinary skill in the art having the benefit of this disclosure.

The present subject matter will now be described with reference to the attached figures. Various structures, systems and devices are schematically depicted in the drawings for purposes of explanation only and to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Embodiments herein are directed to mattresses comprising both comfort and support layers.

Turning to FIG. 1, a stylized top view of a mattress 100, in accordance with embodiments herein, is illustrated. The mattress 100 has a generally rectangular profile in top view, with opposed shorter sides 103, 105 each having a dimension 101, and opposed longer sides 104, 106 each having a dimension 102. Typically, the shorter sides 103, 105 provide the head and foot ends, respectively, of the mattress 100, and the longer sides 104, 106 provide the sides of the mattress 100.

Figure 2:
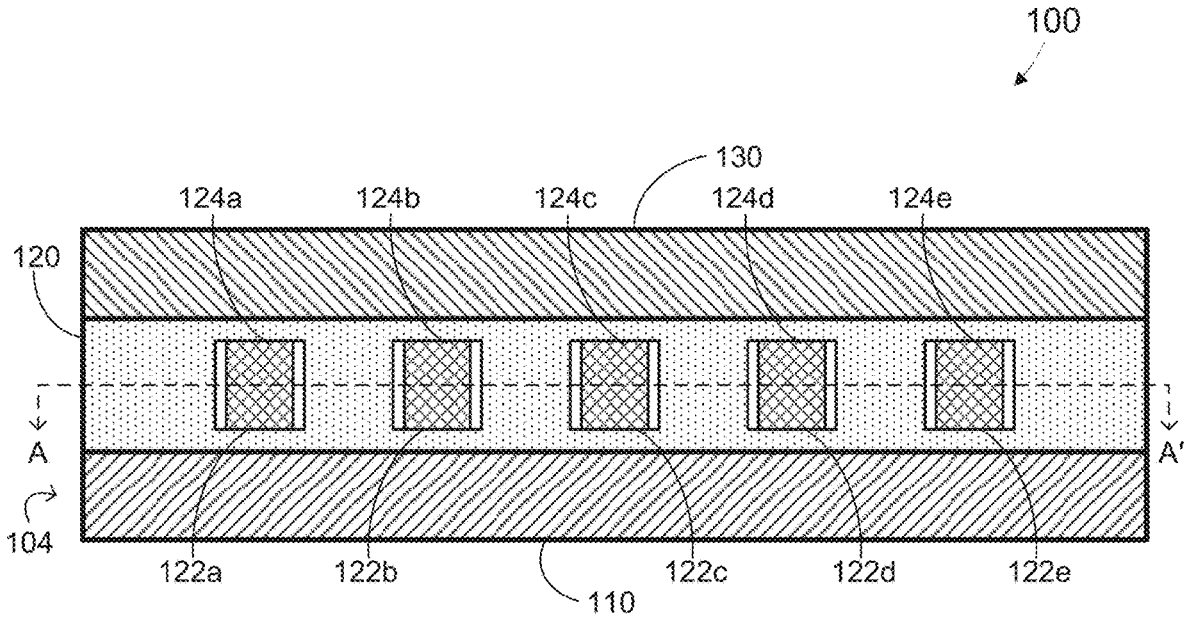
FIG. 2 illustrates a stylized side view of a mattress, in accordance with embodiments herein.

FIG. 2 illustrates a stylized side view of the mattress 100, in accordance with embodiments herein. The side view shows the longer side 104. The mattress 100 includes a polymeric material layer 110, such as a polyurethane layer. The polymeric material layer 110 comprises a foam (e.g., polyurethane foam) that may have any properties suitable for use in a base layer in a mattress. For example, the polymeric material layer 110 may comprise a polyurethane foam having a density from about 10 kg/m$^3$ to about 100 kg/m$^3$.

The mattress 100 further includes an intermediate layer 120 comprising at least one support element (e.g., as shown in FIG. 2, tubular foam springs 124*a*-124*e*). In one embodiment, the support element(s) may be disposed directly above the polymeric material layer 110. The intermediate layer 120 may comprise a visco-elastic foam, a non-viscoelastic foam, or a polyurethane foam, among other materials. In one embodiment, the intermediate layer 120 comprises a non-viscoelastic foam.

A variety of support elements may be included in the intermediate layer 120. For example, the support elements may be metal springs, plastic springs, air bladders, adjustable air bladders, or water bladders, among others known to the person of ordinary skill in the art. Particular support elements included in the intermediate layer 120 will be described in more detail below.

The mattress 100 also comprises a comfort layer 130 disposed directly above the intermediate layer 120. The comfort layer 130 may comprise any material and/or assemblage of sublayers suitable for providing comfort to a user reclining on the mattress 100. In one embodiment, the comfort layer 130 comprises a foam. In a particular embodiment, the comfort layer 130 comprises a viscoelastic foam. For example, the viscoelastic foam may have a density from about 25 kg/m$^3$ to about 250 kg/m$^3$, such as from about 50 kg/m$^3$ to about 120 kg/m$^3$. In an even more particular embodiment, the viscoelastic foam may have a density of about 80-85 kg/m$^3$. Alternatively or in addition, the viscoelastic foam may have a hardness from about 5 N to about 20 N, such as a hardness of about 10 N. Alternatively or in addition, the comfort layer 130 may include a base sublayer and a pillow-top sublayer.

The polyurethane layer 110 and the intermediate layer 120 may be bonded together by any suitable adhesive. The intermediate layer 120 and the comfort layer 130 may also be bonded together by any suitable adhesive. The polyurethane layer 110, the intermediate layer 120, and the comfort layer 130 may be assembled using any process and/or equipment known in the art.

For the avoidance of doubt, and in accordance with practice before the United States Patent and Trademark Office, none of the present figures are to scale.

The intermediate layer 120 will now be described in more detail, with reference to FIGS. 3-6. In one embodiment, each of the support elements is selected from the group consisting of tubular foam springs 124*a*-124*e*, foam spheres (described below with reference to FIGS. 4-5), or foam hemispheres (described below).

Tubular foam springs 124*a*-124*e* generally having a tubular resilient body made of foam and forming an outer wall.

In one embodiment, the intermediate layer 120 may comprise at least one channel 122 extending laterally from a first side 104 to an opposite side 106 of the mattress 100, and a plurality of support elements 124 disposed in the channel 122. In the particular embodiment shown in FIG. 2, the intermediate layer 120 comprises five channels 122*a*-122*e*. In side view, in each channel 122*a*-122*e*, only one tubular foam spring 124*a*-124*e* is visible in the view depicted in FIG. 2.

Figure 3:
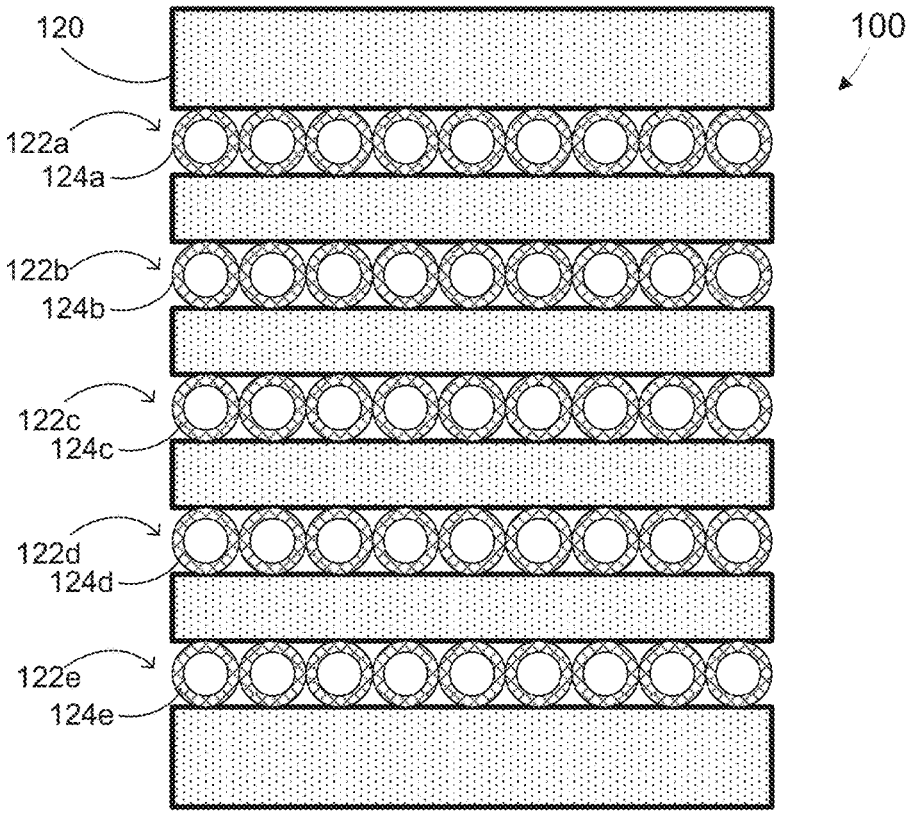
FIG. 3 illustrates a stylized top sectional view of the mattress of FIG. 2 along the line A-A', in accordance with embodiments herein.

Turning to FIG. 3, a sectional view taken along the line A-A' in FIG. 2 is shown. This sectional view looks down across the middle of the intermediate layer 120. As shown, each channel 122*a*-122*e* comprises a plurality of tubular foam springs. FIG. 3 illustrates sets of tubular foam springs 124*a*-124*b*, appearing as rounded features, configured within respective channels 122*a*-122*e*. The channels 122*a*-122*e* are formed from multiple intermediate layer portions.

Figure 4:
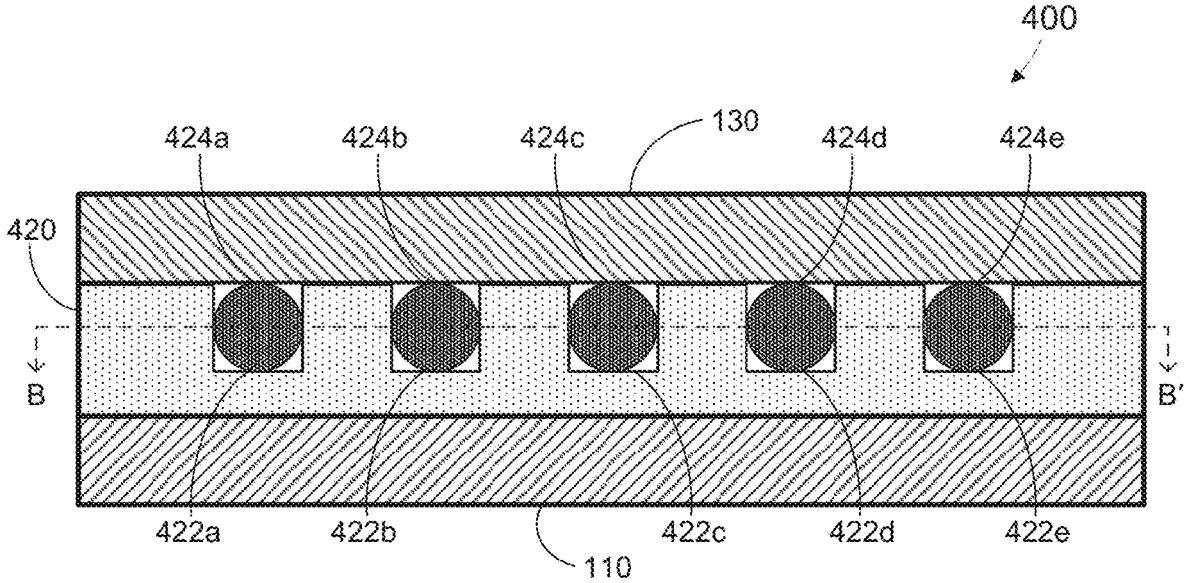
FIG. 4 illustrates a stylized side view of a mattress, in accordance with embodiments herein.
Figure 5:
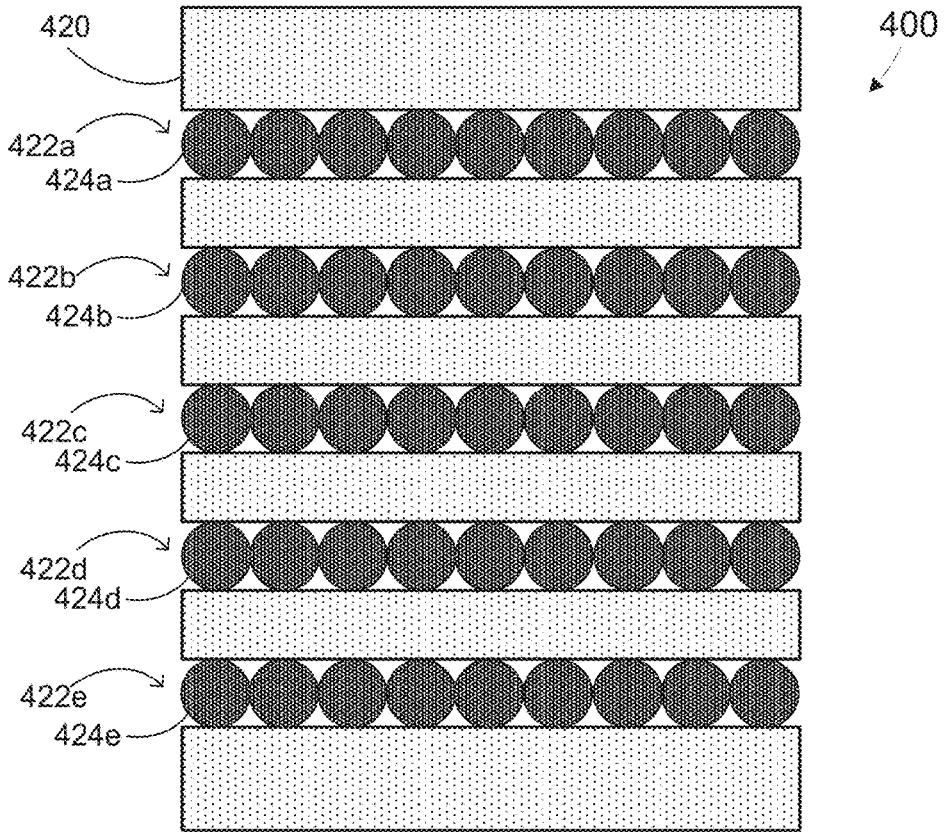
FIG. 5 illustrates a stylized top sectional view of the mattress of FIG. 4 along the line B-B', in accordance with embodiments herein.

In another embodiment, as shown in FIGS. 4-5, the mattress 100 includes an intermediate layer 420 comprising at least one support element (e.g., as shown in FIG. 4, foam spheres 424*a*-424*e*). In some embodiment, the support element(s) may be disposed directly above the polymeric material layer 110. The intermediate layer 420 comprises a plurality of foam spheres 424*a*-424*e*. FIG. 4 illustrates a stylized side view of a mattress 400 and FIG. 5 illustrates a stylized top sectional view of the mattress 400 of FIG. 4 along the line B-B', in accordance with embodiments herein.

As depicted, the mattress 400 comprises a plurality of channels 422*a*-422*e*. In side view, one of the foam spheres 424*a*-424*e* is visible in each channel 422*a*-422*e*. Each foam sphere 424 may comprise any known foam material. The foam spheres 424*a*-424*e* may provide relief to pressure points of a user reclining on the comfort layer 130 of the mattress 400.

In the top sectional view shown in FIG. 5, each channel 422*a*-422*e* comprises a plurality of foam spheres.

Although FIGS. 4-5 depict foam spheres 424*a*-424*e*, in another embodiment, the support elements may be a plurality of foam hemispheres (not shown), substantially the same as the foam spheres 424*a*-424*e*, differing in that the foam hemispheres are each disposed with a flat surface against the bottom of the channel 422.

Even though FIGS. 2-5 depict mattresses 100, 400 comprising only tubular foam springs 124 or foam spheres 424, in embodiments, a mattress according to the present disclosure may comprise both tubular foam springs and foam spheres and/or hemispheres. Tubular foam spring and foam spheres/hemispheres may be mixed within one or more channels of an intermediate layer 120 or 420, one or more channels may contain only one of tubular foam springs, foam spheres, or foam hemispheres, or both.

Although FIGS. 2-5 depict particular numbers of channels 122 or 422 and particular numbers of tubular foam springs 124 or foam spheres 424, the person of ordinary skill in the art having the benefit of the present disclosure, will understand that variations in the number and sizes of channels and support elements will be within the scope of the present disclosure.

Figure 6:
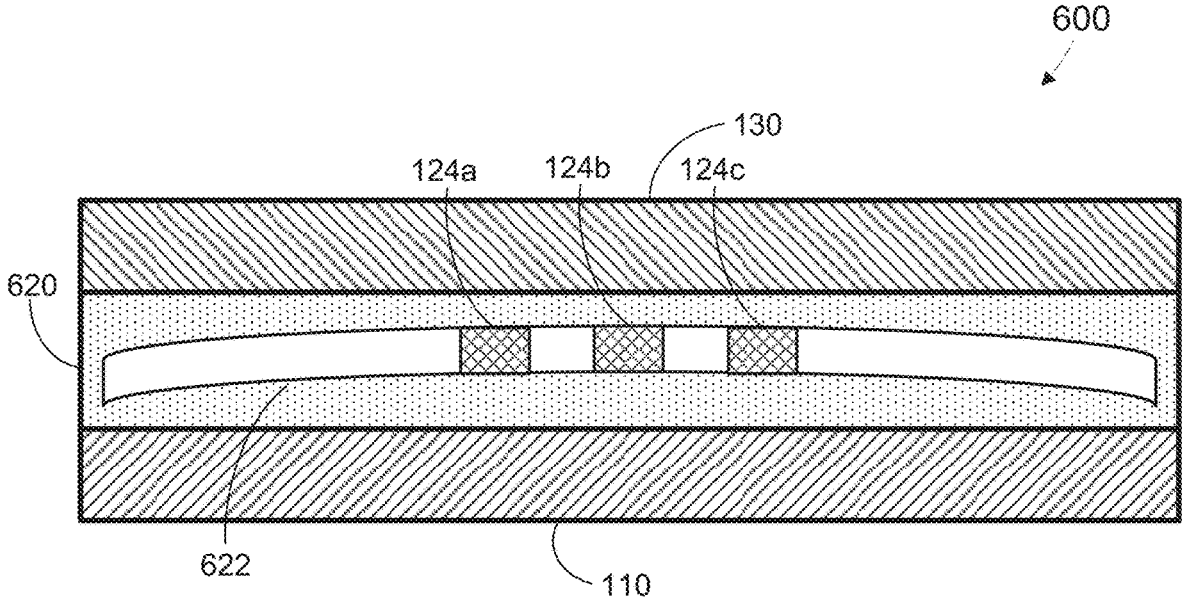
FIG. 6 illustrates a stylized side view of a mattress, in accordance with embodiments herein.

FIG. 6 illustrates a stylized side view of a mattress 600, in accordance with embodiments herein. The mattress 600 somewhat resembles mattress 100 depicted in FIGS. 2-3 in that the intermediate layer 620 comprises a plurality of tubular foam springs 124*a*-124*c*. However, instead of a plurality of channels 122*a*-122*e* depicted in FIGS. 2-3, the mattress 600 depicted in side view in FIG. 6 comprises a single channel 622. In the particular embodiment of FIG. 6, the channel 622 is curved upward in side view. Other orientations of the channel 622, e.g., flat, curved downward, etc., may be used. As depicted, the channel 622 may have an essentially constant height. In other embodiments (not shown), the channel 622 may vary in height, e.g., may be shorter at the left and right sides and taller in the middle. Variations in the channel 622 may be made as a routine matter by the person of ordinary skill in the art having the benefit of the present disclosure.

Figure 7:
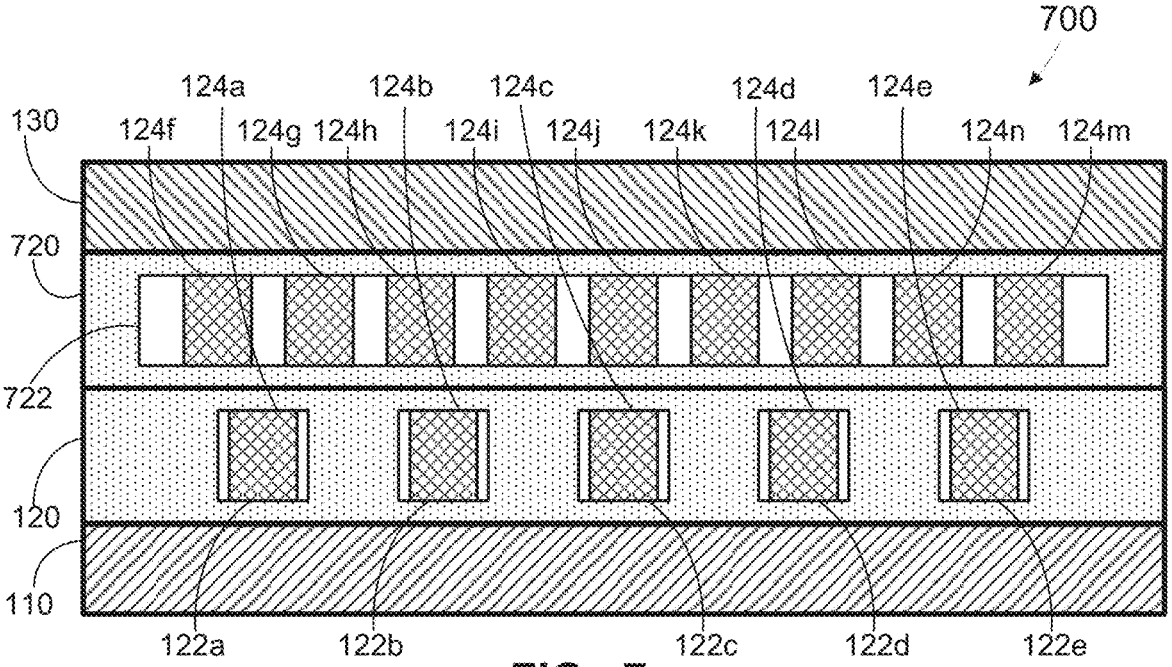
FIG. 7 illustrates a stylized side view of a mattress, in accordance with embodiments herein.
Figure 8:
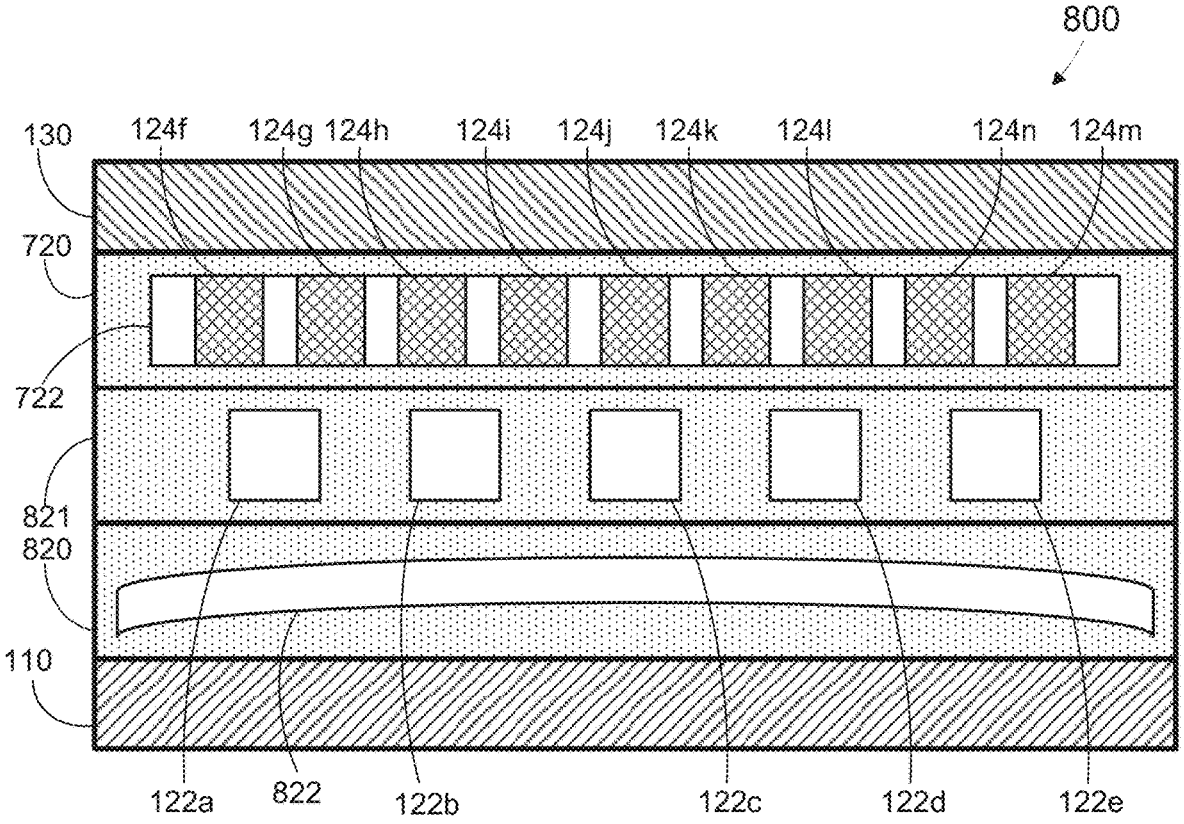
FIG. 8 illustrates a stylized side view of a mattress, in accordance with embodiments herein.

FIGS. 2-6 depict mattresses 100, 400, and 600, each comprising one intermediate layer 120, 420, or 620. Turning to FIGS. 7-8, mattresses 700 and 800, each comprising of two or three intermediate layers, respectively, are shown.

FIG. 7 depicts a mattress 700 comprising two intermediate layers 120 and 720. The first intermediate layer 120 is as described above. The second intermediate layer 720 is similar to the first, in that it may comprise the same material and also comprises at least one support element (e.g., tubular foam springs 124*f*-124*m*) disposed in a channel 722. The second intermediate layer 720 depicted in FIG. 7 comprises a single channel 722.

FIG. 8 depicts a mattress 800 comprising three intermediate layers 120, 720, and 820. The first intermediate layer 821 and the second intermediate layer 720 are generally as described above. The first intermediate layer 821 differs from that described above in that the channels 122*a*-122*e* do not contain support elements 124. As should be apparent, the first intermediate layer 821 shown in FIG. 8 may be substituted for any other first intermediate layer 120 comprising support elements 124 in one or more channels 122. The third intermediate layer 820 resembles the intermediate layer 620 depicted in FIG. 6, differing in that the tubular foam springs 124*a*-124*c* depicted in FIG. 6 are omitted.

A variety of intermediate layers 120, 420, 620, 720, 820, and 821 have been depicted in FIGS. 2-8. In embodiments wherein a mattress comprises one intermediate layer, the intermediate layer may be any one of the intermediate layers 120, 420, 620, 720, 820, and 821, along with others not depicted but described herein. For example, any intermediate layer shown comprising one or more support elements disposed in a channel may be substituted with an otherwise-identical intermediate layer lacking support elements in a channel, or vice versa. In such embodiments, a single intermediate layer is simultaneously the bottom-most intermediate layer and the uppermost intermediate layer.

In embodiments wherein a mattress comprises two, three, or more intermediate layers, each intermediate layer may comprise any one of the intermediate layers 120, 420, 620, 720, and 820, along with others not depicted but described herein. Any one of the intermediate layers 120, 420, 620, 720, and 820, along with others not depicted but described herein may be duplicated in a mattress comprising two or more intermediate layers. Alternatively or in addition, in any mattress comprising two or more intermediate layers, any one of the intermediate layers 120, 420, 620, 720, and 820, along with others not depicted but described herein. May be arranged in any order, i.e., any intermediate layer 120, 420, 620, 720, or 820, or any other not depicted but described herein, may be the bottom-most intermediate layer, the uppermost intermediate layer, or at any position between the bottom-most and uppermost intermediate layers.

Figure 9:
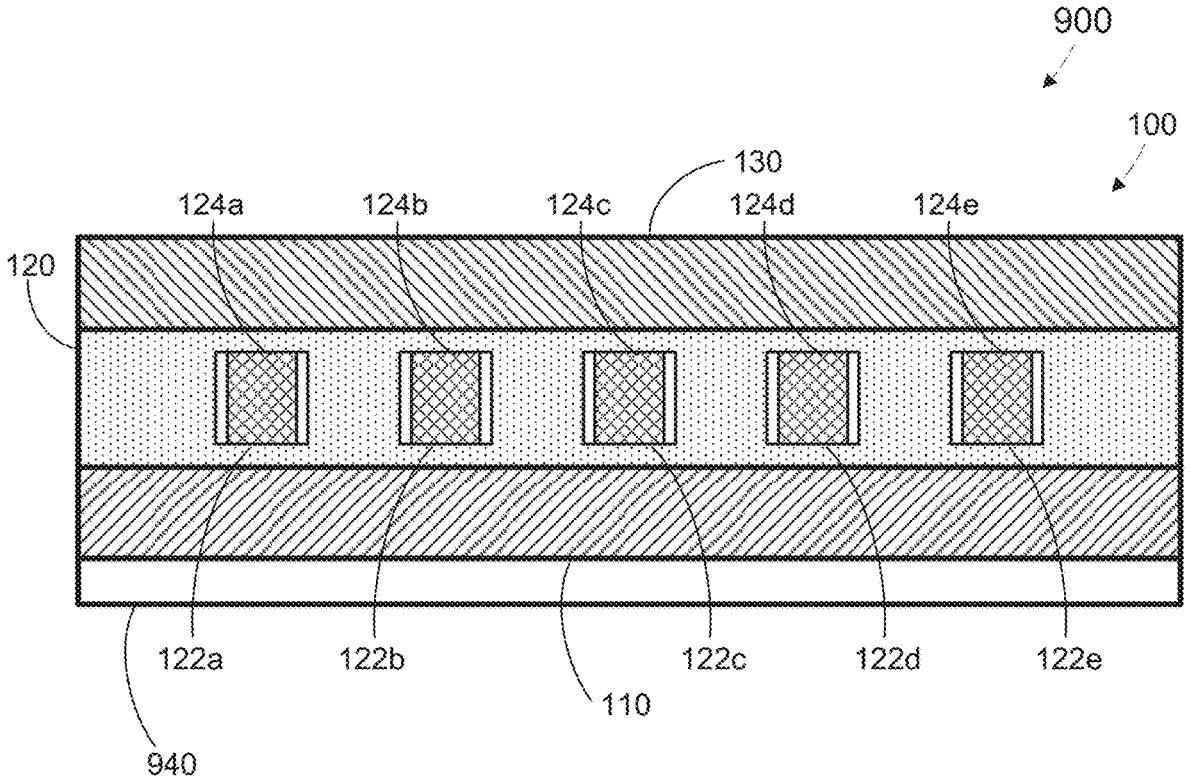
FIG. 9 illustrates a stylized side view of a mattress assembly, in accordance with embodiments herein.

In another embodiment, as depicted in stylized side view in FIG. 9, the present disclosure relates to a mattress assembly 900, in accordance with embodiments herein. The mattress assembly 900 comprises a mattress as described above, such as a mattress 100 comprising a plurality of channels 122*a*-122*e*, each comprising at least one tubular foam spring 124*a*-124*e*.

The mattress assembly 900 also comprises a mattress foundation 940 disposed under the mattress 100. The mattress foundation 940 may comprise any structure known to the person of ordinary skill in the art for the support of mattresses. Exemplary mattress foundations 940 include, but are not limited to, box springs; metal frames; and adjustable supports, including electromechanically adjustable supports; among others.

Figure 10:
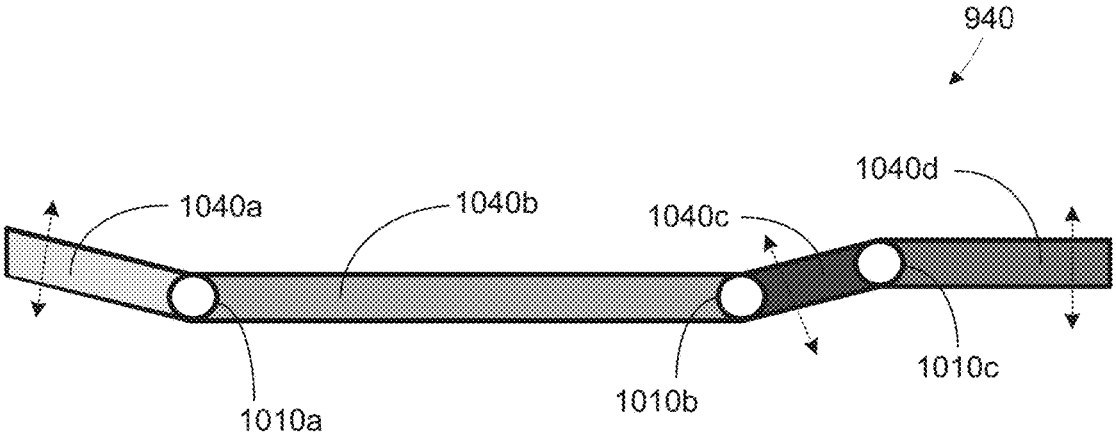
FIG. 10 illustrates a stylized side view depiction of the mattress foundation of FIG. 9, in accordance with embodiments herein.

FIG. 10 illustrates a stylized depiction of the mattress foundation of FIG. 9, in accordance with embodiments herein. In some embodiments, the mattress foundation may be comprised of two or more sections. For example, the mattress foundation 940 may comprise a $1^{st}$ section 1040*a*, a $2^{nd}$ second section 1040*b*, a $3^{rd}$ section 1040*c*, and a $4^{th}$ section 1040*d*. Some or all of the sections 1040*a*-1040*d* may be configured to move independently, as indicated by the dotted lines over the $1^{st}$ section 1040*a*, the $3^{rd}$ section 1040*c*, and the $4^{th}$ section 1040*d*.

Each of the $1^{st}$ through $4^{th}$ section 1040*a*-1040*d* may be connected to pivot points to allow for independent movements. For example, the $1^{st}$ section 1040*a* and the $2^{nd}$ section 1040*b* may be movably coupled to a $1^{st}$ pivot point 1010*a*. In one embodiment, the $1^{st}$ section may move up and down about the $1^{st}$ pivot point 1010*a*. The $1^{st}$ section 1040*a* may be at the head of a bed.

The $2^{nd}$ section 1040*b* and the $3^{rd}$ section may be movably coupled to a $2^{nd}$ pivot point 1010*b*. In one embodiment, the $3^{rd}$ section may move up and down about the $2^{nd}$ pivot point 1010*b*.

The $3^{rd}$ section 1040*c* and the $4^{th}$ section 1040*d* may be movably coupled to a 3rd pivot point 1010*c*. In one embodiment, the $4^{th}$ section may move up and down about the $3^{rd}$ pivot point 1010*c*. In one embodiment, the $4^{th}$ section may be at the foot of a bed. Those skilled in the art would appreciate that additional sections and/or pivot points may be implemented onto the mattress foundation 940 and remain with the spirit and scope of embodiments herein.

The particular embodiments disclosed above are illustrative only, as the disclosure may be modified and practiced in different, but equivalent manners, apparent to those skilled in the art having the benefit of the teachings herein. For example, the process steps set forth above may be performed in a different order. Furthermore, no limitations are intended to the details of construction or design herein shown, other than as described in the claims below. It is, therefore, evident that the particular embodiments disclosed above may be altered or modified and all such variations are considered within the scope and spirit of the disclosure. Accordingly, the protection sought herein is as set forth in the claims below.

What is claimed is:

1. A mattress, comprising:

a polyurethane layer;

at least one intermediate layer comprising one and only one channel, wherein the channel comprises a ceiling, and the intermediate layer is continuous above the ceiling of the channel, wherein a bottom-most intermediate layer is disposed directly above the polyurethane layer; and a comfort layer disposed directly above an uppermost intermediate layer wherein (i) the ceiling of the channel in the center of the channel is higher than both the ceiling at an end nearest a head of the mattress and the ceiling at an end nearest a foot of the mattress, and (ii)

the channel comprises a floor opposite the ceiling and the floor of the channel in the center of the channel is higher than both the floor at the end nearest the head of the mattress and the floor at the end nearest the foot of the mattress.

2. The mattress of claim 1, wherein the comfort layer comprises a foam.

3. The mattress of claim 2, wherein the foam is a viscoelastic foam.

4. The mattress of claim 1, wherein the one and only channel extends laterally from a first side to an opposite side and has a plurality of support elements disposed in the channel.

5. The mattress of claim 4, wherein each of the support elements is selected from the group consisting of tubular foam springs, foam spheres, or foam hemispheres.

6. The mattress of claim 1, wherein at least one intermediate layer comprises a non-viscoelastic foam.

7. A mattress assembly, comprising:

a mattress, comprising:

a polyurethane layer;

at least one intermediate layer comprising one and only one channel, wherein the channel comprises a ceiling, and the intermediate layer is continuous above the ceiling of the channel, wherein a bottom-most intermediate layer is disposed directly above the polyurethane layer;

a comfort layer disposed directly above an uppermost intermediate layer; and a mattress foundation disposed under the mattress;

wherein (i) the ceiling of the channel in the center of the channel is higher than both the ceiling at an end nearest a head of the mattress and the ceiling at an end nearest a foot of the mattress, and (ii) the channel comprises a floor opposite the ceiling and the floor of the channel in the center of the channel is higher than both the floor at the end nearest the head of the mattress and the floor at the end nearest the foot of the mattress.

8. The mattress assembly of claim 7, wherein the comfort layer comprises a foam.

9. The mattress assembly of claim 8, wherein the foam is a viscoelastic foam.

10. The mattress assembly of claim 7, wherein the one and only channel extends laterally from a first side to an opposite side and has a plurality of support elements disposed in the channel.

11. The mattress assembly of claim 10, wherein each of the support elements is selected from the group consisting of tubular foam springs, foam spheres, or foam hemispheres.

12. The mattress assembly of claim 7, wherein at least one intermediate layer comprises a non-viscoelastic foam.

13. A mattress, comprising:

a polyurethane layer;

at least one intermediate layer comprising one and only one channel, wherein the channel comprises a ceiling, and the intermediate layer is continuous above the ceiling of the channel, wherein a bottom-most intermediate layer is disposed directly above the polyurethane layer, and at least one intermediate layer comprises at least one channel extending laterally from a first side to an opposite side and a plurality of support elements disposed in the channel; and a viscoelastic foam layer disposed directly above an uppermost intermediate layer;

wherein (i) the ceiling of the channel in the center of the channel is higher than both the ceiling at an end nearest a head of the mattress and the ceiling at an end nearest a foot of the mattress, and (ii) the channel comprises a floor opposite the ceiling and the floor of the channel in the center of the channel is higher than both the floor at the end nearest the head of the mattress and the floor at the end nearest the foot of the mattress.

14. The mattress of claim 13, wherein each of the support elements is selected from the group consisting of tubular foam springs, foam spheres, or foam hemispheres.

* * * * *